US007926455B2

(12) United States Patent
Manther et al.

(10) Patent No.: US 7,926,455 B2
(45) **Date of Patent: *Apr. 19, 2011**

(54) ROLLER FINGER FOLLOWER FOR VALVE DEACTIVATION

(75) Inventors: Debora Manther, Royal Oak, MI (US); Yunshan Liu, Rochester Hills, MI (US); Anna Strehlau, Windsor (CA); Richard Best, Garden City, MI (US); Xiaopo Ma, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 494 days.

This patent is subject to a terminal disclaimer.

(21) Appl. No.: 12/132,232

(22) Filed: Jun. 3, 2008

(65) Prior Publication Data

US 2008/0295789 A1 Dec. 4, 2008

Related U.S. Application Data

(60) Provisional application No. 60/941,732, filed on Jun. 4, 2007.

(51) Int. Cl.
*F01L 1/34* (2006.01)

(52) U.S. Cl. ..... 123/90.16; 123/90.39; 123/90.44

(58) Field of Classification Search ..... 123/90.39, 123/90.44, 90.41, 90.42, 90.43, 90.45, 90.16
See application file for complete search history.

(56) References Cited

U.S. PATENT DOCUMENTS

| | | | | |
|---|---|---|---|---|
| 5,655,488 | A * | 8/1997 | Hampton et al. | 123/90.16 |
| 7,174,869 | B2 * | 2/2007 | Proschko et al. | 123/90.39 |
| 2006/0260579 | A1 * | 11/2006 | Proschko et al. | 123/90.41 |
| 2007/0186890 | A1 * | 8/2007 | Zurface et al. | 123/90.44 |
| 2008/0295789 | A1 * | 12/2008 | Manther et al. | 123/90.45 |

* cited by examiner

*Primary Examiner* — Thomas E Denion
*Assistant Examiner* — Daniel A Bernstein
(74) *Attorney, Agent, or Firm* — Lucas & Mercanti, LLP

(57) ABSTRACT

The finger follower has an inner and outer body and a torsional lost motion spring positioned at its lash adjuster end of the outer body. The torsional lost motion springs have a short leg that abuts the outer body and a long leg that contacts the inner body. The torsional spring is located above the pivot point of the finger follower so as to provide a low mass moment of inertia and to reduce the weight over the valve stem end of the follower.

9 Claims, 5 Drawing Sheets

ROLLER FINGER FOLLOWER FOR VALVE DEACTIVATION

FIELD OF INVENTION

The invention relates to roller finger followers that are used in overhead cam type internal combustion engines and, more particularly, to switchable roller finger followers that have a high lift, low lift, and no lift mode.

BACKGROUND OF THE INVENTION

Switchable roller finger followers that have a high lift mode, a low lift mode, and a no lift mode are known. Typically, such finger followers have an outer elongated body, one end of which mates with a valve stem and operates on the valve stem, and a second end which is in contact with a hydraulic lash adjuster. An inner elongated body is centrally located in the outer elongated body and houses a cam follower that is operated on by the cam so as to provide motion to the finger follower. The inner elongated body has two modes, a locked mode and an unlocked mode. A latching mechanism is part of the finger follower and is used to lock the inner elongated body in a stationary position. When the inner elongated body is locked in a stationary position, the cam which is fixed to the cam shaft of the engine forces the movement of the finger follower which translates into the movement of the valve through the valve stem. In order to deactivate the finger follower, the latch is released and the inner elongated body is unlocked and can travel freely up and down in conjunction with the cam without transferring the motion of the cam to the finger follower.

In order to maintain contact between the cam and the cam follower during the unlocked periods, a lost motion spring is employed. A typical lost motion spring is either helical or torsional.

OBJECT OF THE INVENTION

It is the object of the invention to design a switchable roller finger follower for an overhead cam internal combustion engine having a low mass moment of inertia about the pivot axis of the finger follower. These and other objects of the present invention may be more fully understood by reference to the following description.

SUMMARY OF THE INVENTION

The object of the present invention is achieved by locating the lost motion spring at the lash adjuster end of the finger follower, above the lash adjuster. In order to locate the lost motion spring above the lash adjuster at the lash adjuster end of the finger follower, lost motion spring pins and lost motion spring stops are provided to the outer housing of the finger follower to secure lost motion torsional springs on the finger follower and lost motion spring pallets are located on the inner housing in which the cam follower is housed. The pallets provide a contact surface for one leg of the lost motion torsional spring while the stops provide a contact surface for the other leg of the lost motion torsional spring.

Broadly, the switchable roller finger follower of the present invention can be defined as follows:

- an outer elongated body having a valve stem end, a lash adjuster end, and two outer elongated body side walls;
- a first inner cavity in said outer elongated body;
- two lost motion spring pins attached to said lash adjuster end of said outer elongated body;

- two lost motion spring stops, one of each of said stops positioned on one of each of said outer elongated body side walls and adjacent to said lash adjuster end;
- an inner elongated body positioned in said first inner cavity and having a first end pivotally attached to said outer elongated body at said valve stem end, a second end adjacent to said lash adjuster end, and two inner elongated body side walls;
- a second inner cavity in said inner elongated body;
- two lost motion spring pallets, one of each of said pallets fixed on one of each of said inner elongated body side walls at said second end;
- a center cam follower in said second inner cavity;
- a latch assembly fixed to said outer elongated body at said lash adjuster end for preventing pivoting of the inner elongated body; and
- two lost motion torsional springs, one of each of said springs on one of each of said lost motion pins, each of said springs having a short leg and a long leg, the short leg of each of springs abutting one of said stops and the long leg of each of said springs abutting one of said pallets.

The pallets and the long leg of the torsional springs have mutual contact surfaces. It is preferred that these contact surfaces are convex and, more preferably, one or more of the contact surfaces is involute.

The inside wall of the outer elongated body side wall preferably has a recess which accommodates the movement of the pallets.

The pallets are preferably finger shaped, one side of which is curved and provides a contact surface.

These and other aspects of the present invention may be more fully understood by reference to one or more of the following drawings and the detailed description thereof.

DETAILED DESCRIPTION OF THE DRAWINGS

Figure 1:
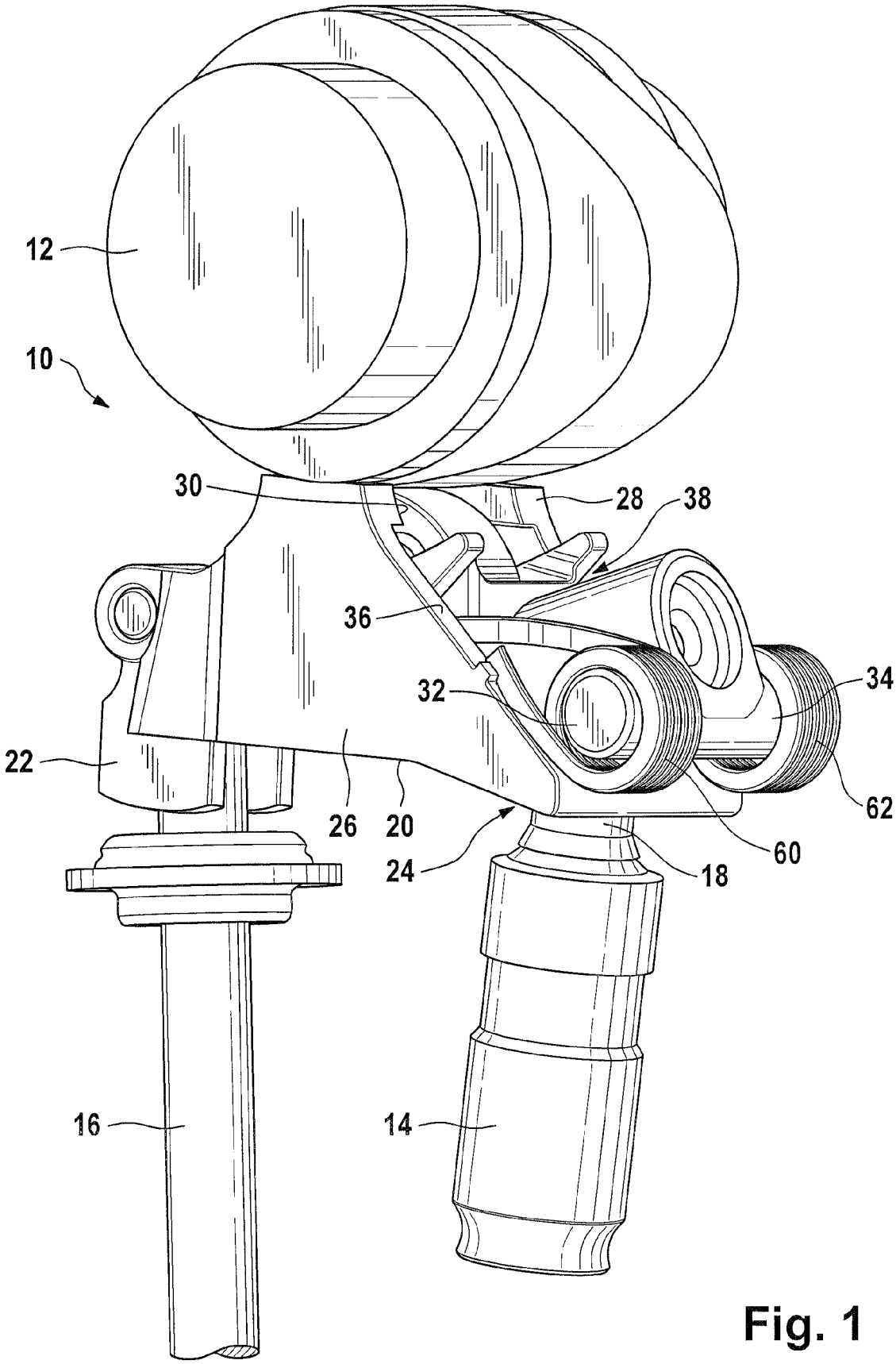
FIG. 1 illustrates a finger follower of the present invention with the valve stem, the cam, and the lash adjuster.
Figure 2:
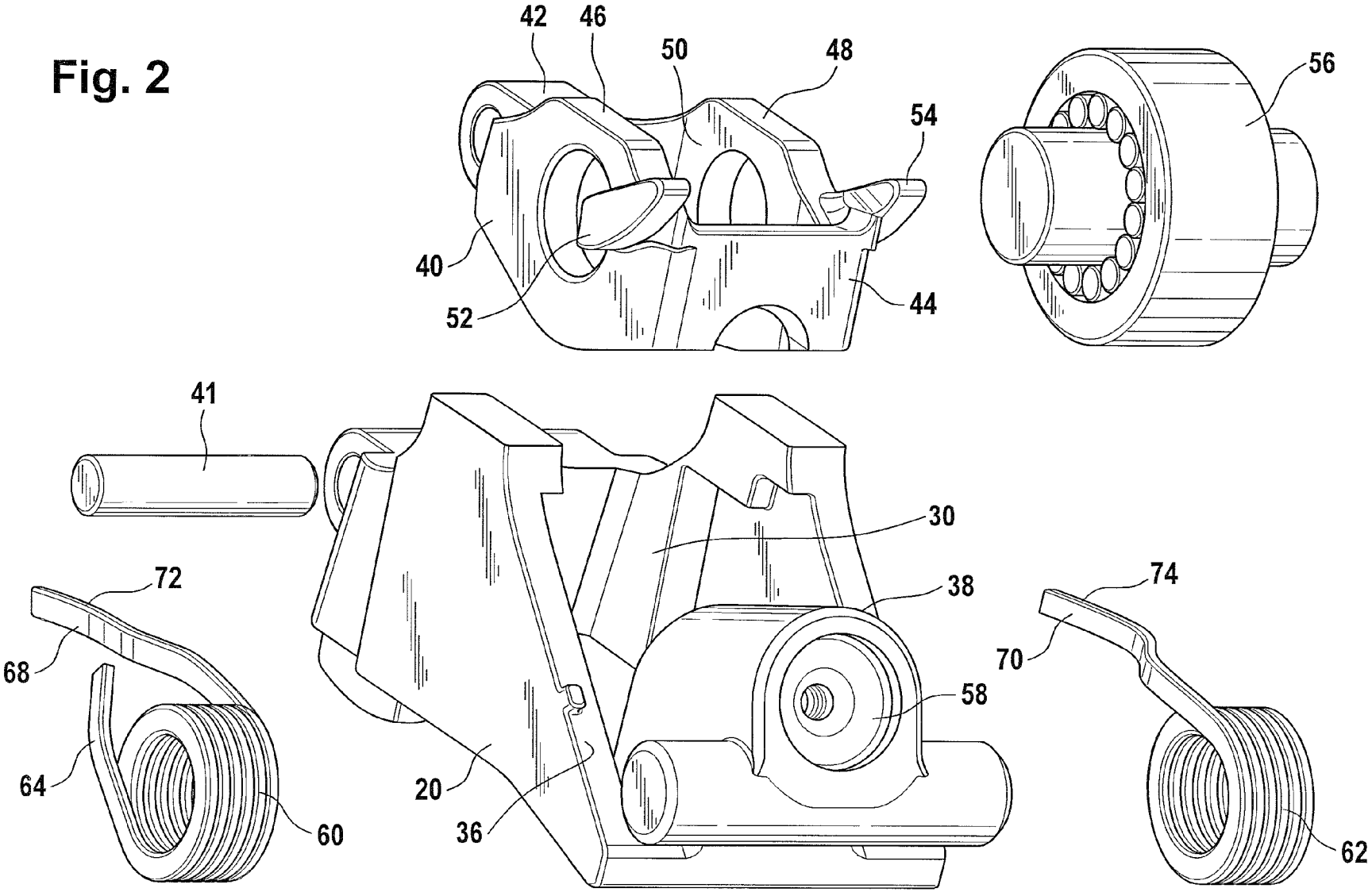
FIG. 2 is an exploded view of the finger follower of the present invention.

FIG. 1 illustrates finger follower 10 which is acted on by cam 12. Finger follower 10 pivots and is in contact with lash adjuster 14. Finger follower 10 through its pivot action operates on valve stem 16 to open and close the valve in a cylinder of an internal combustion engine. Finger follower 10 has pivot point 18, which is the point of contact between finger follower 10 and lash adjuster 14.

Finger follower 10 comprises an outer elongated body 20 having a valve stem end 22, a lash adjuster end 24, and two elongated body side walls 26 and 28.

First inner cavity 30, in outer elongated body 20, is defined by valve stem end 22, lash adjuster end 24 and side walls 26 and 28. Affixed to outer elongated body 20, at its lash adjuster end 24, are lost motion spring pins 32 and 34.

Each of the side walls 26 and 28 provide lost motion spring stops 36 and 38.

Positioned in first inner cavity 30 is inner elongated body 40. Inner elongated body 40 has a first end 42 which is pivotally attached to the valve stem end 22 of outer elongated body 20, by pin 41 a second end 44 which is adjacent to lash adjuster end 24 and two inner elongated side walls 46 and 48.

Second inner cavity 50 is positioned in inner elongated body 42 and is defined by first end 42, second end 44 and side walls 46 and 48.

Two lost motion pallets 52 and 54 are affixed to side walls 46 and 48.

A center cam follower 56 is mounted in second inner cavity 50.

Latch assembly 58 forms part of outer elongated body 20. Latch assembly 58 is a conventional latch assembly which is operated in a conventional manner in order to lock the inner elongated body 40.

Lost motion springs 60 and 62 are positioned on pins 32 and 34 respectively. Lost motion springs 60 and 62 have a short leg 64 and 66 which abut lost motion spring stops 36 and 38 respectively. Long legs 68 and 70 of lost motion springs 60 and 62 extend into first inner cavity 30 and abut pallets 52 and 54 respectively.

Figure 5:
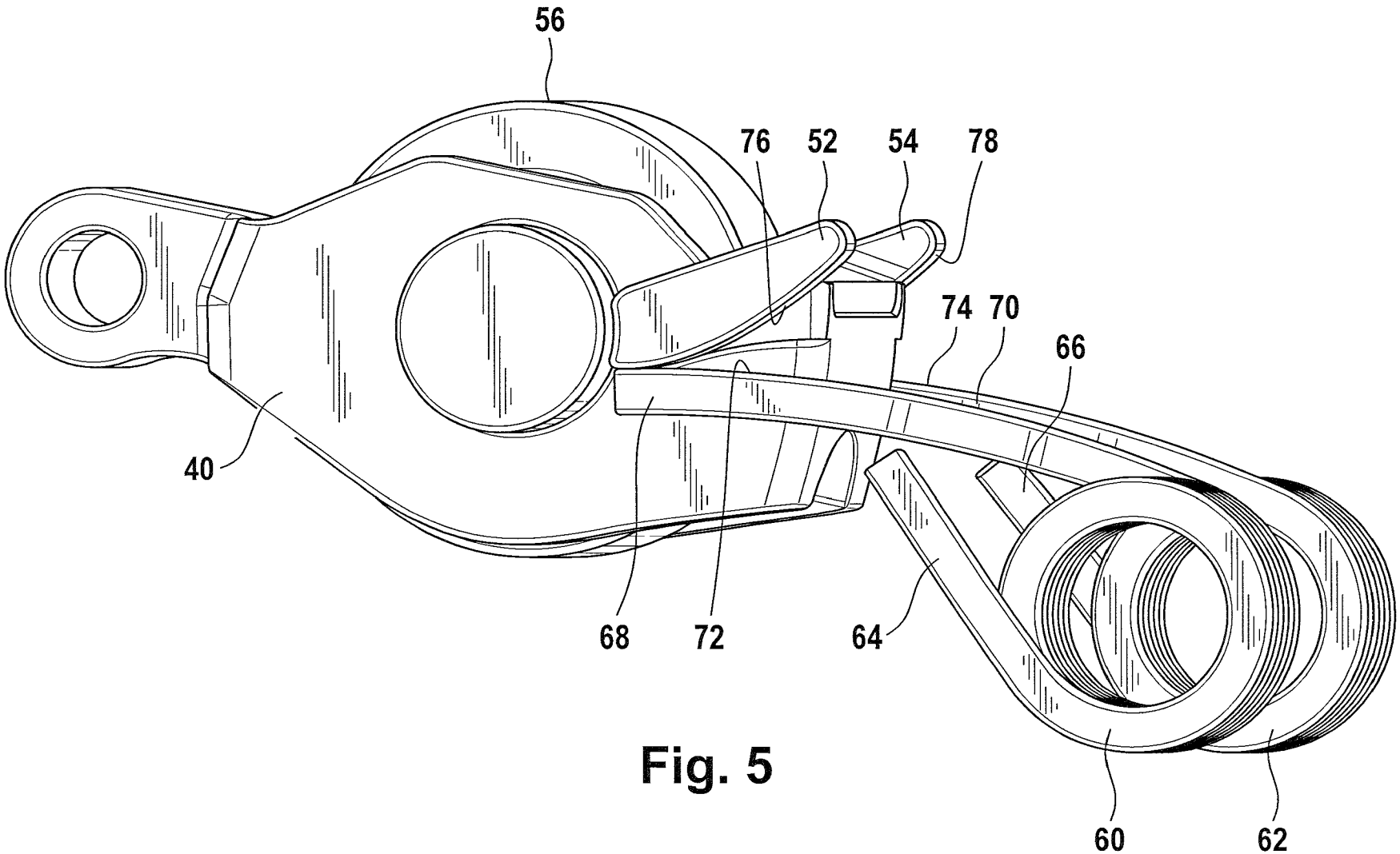
FIGS. 5 and 6 illustrate the motion of the inner elongated body and the cam follower when acted upon by the cam and when the latch is in the unlatched state.
Figure 6:
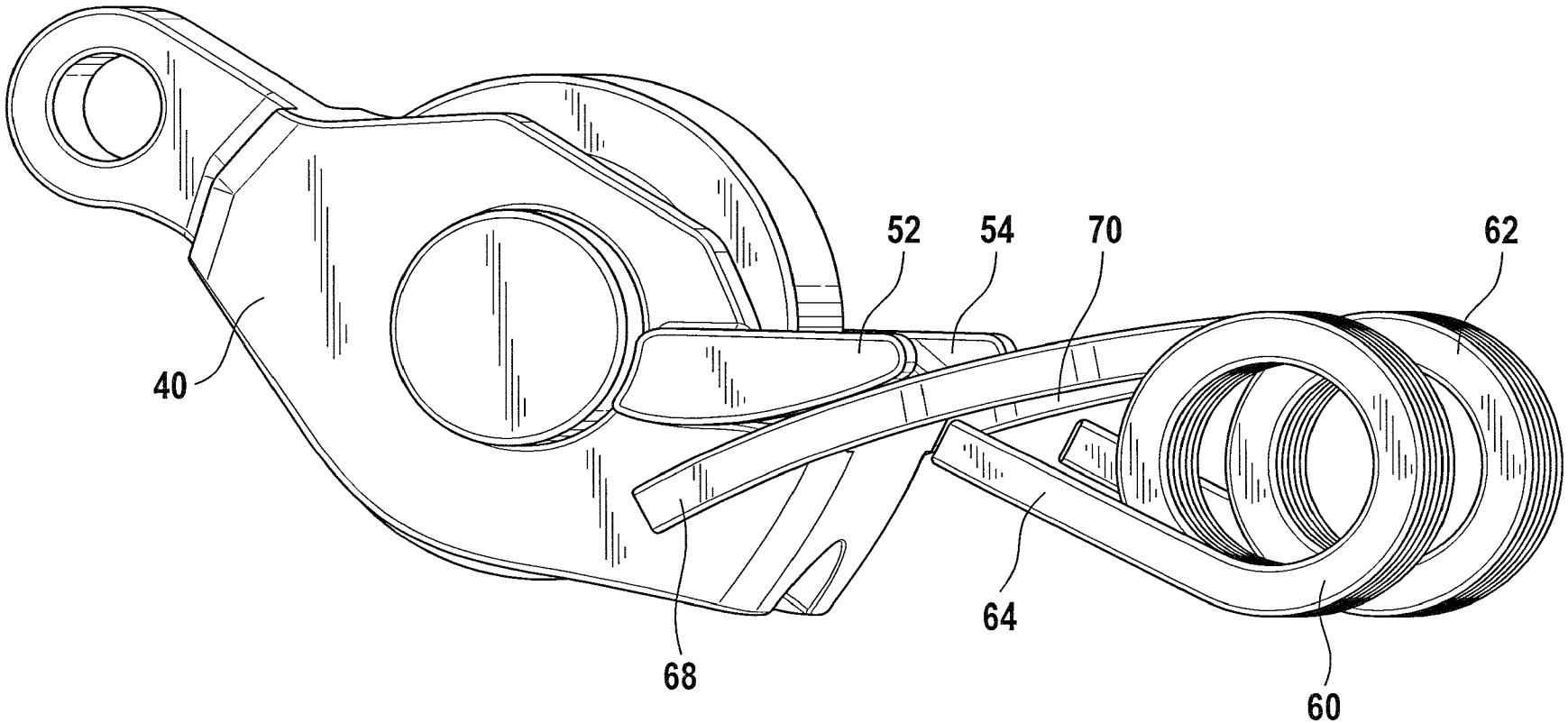

As can be seen in FIGS. 5 and 6, long legs 68 and 70 have contact surfaces 72 and 74. Contact surfaces 72 and 74 are each convex, and, more preferably are involute.

Pallets 52 and 54 have contact surfaces 76 and 78. Contact surfaces 76 and 78 are convex, and more preferably, involute. Contact surface 72 contacts contact surface 76 and contact surface 74 contacts contact surface 78.

Figure 3:
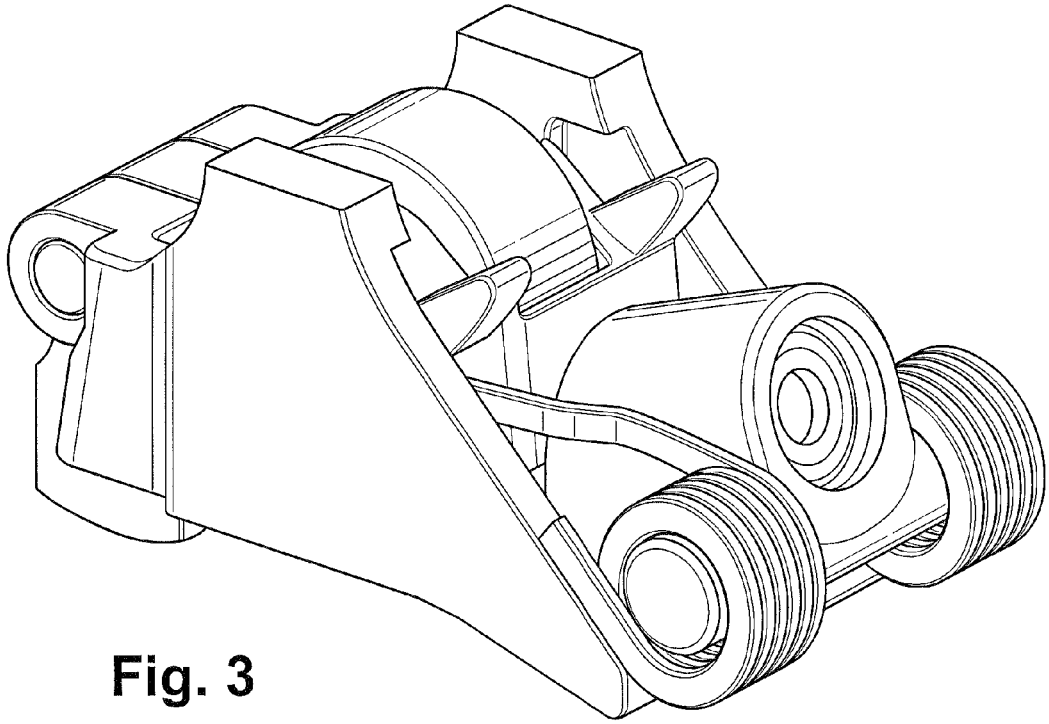
FIGS. 3 and 4 illustrate the action of the lost motion spring when the cam acts on the cam follower and the latch assembly has not been latched.
Figure 4:
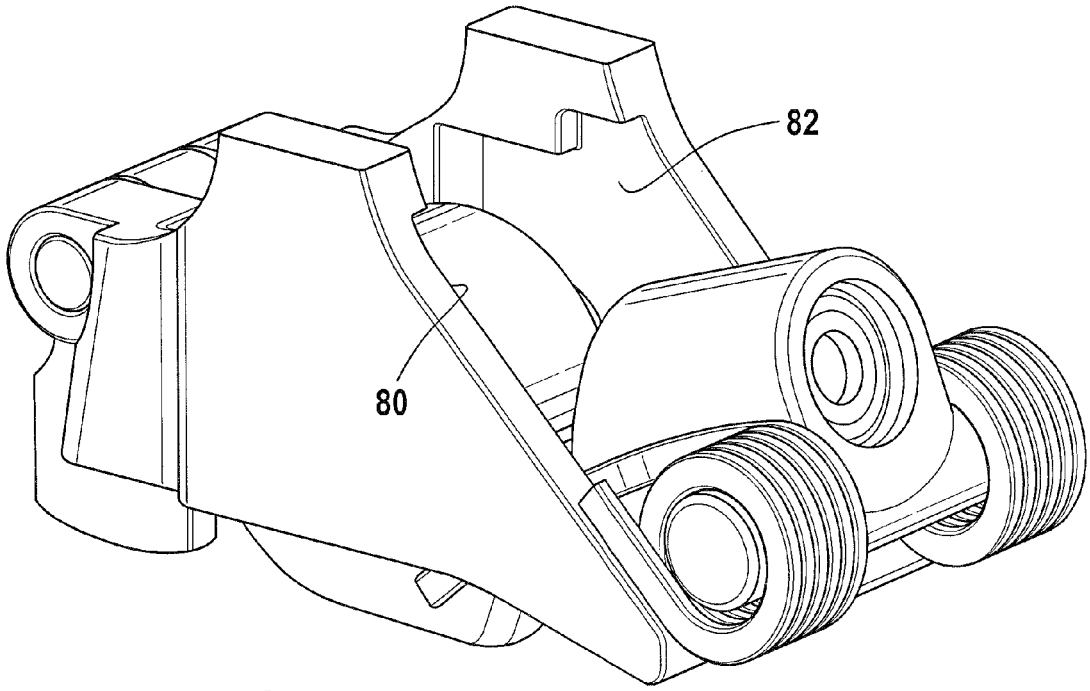

As can be seen in FIG. 4 both side walls 26 and 28 have recesses 80 and 82, respectively. Recesses 80 and 82 provide clearance for the movement of pallets 52 and 54 as inner elongated body 40 pivots about its first end 42. This pivoting action is visible in FIG. 3 and FIG. 4.

The interaction between contact surfaces 72, 74, 76, and 78 are shown in FIG. 5 and 6. It is preferred that each of the contact surfaces are convex so that they do not interfere with one another.

Lost motion springs 60 and 62 are positioned above the pivot point of finger follower 10.

Preferably, pallets 52 and 54 are molded as part of inner elongated body 40. Contact surface 76 to 78 can be specially treated to provide for good reduced wear between contact surfaces 72 and 74.

It will be noted that by locating lost motion springs 60, 62 above pivot point 18, less weight is provided above the valve stem. Also, by positioning the lost motion spring above the pivot point, the mass motion of inertia about the pivot point is improved.

Suitable lost motion springs are sized for the dynamic loads required by the system to maintain cam contact, based on the hinge point and mass moment of inertia of the system.

REFERENCE CHARACTERS

10 Finger follower
12 cam
14 lash adjuster
16 valve stem
18 pivot point of finger follower
20 outer elongated body
22 valve stem end
24 lash adjuster end
26 side wall
28 side wall
30 first inner cavity
32 pins
34 pins
36 lost motion spring stop
38 lost motion spring stop
40 inner elongated body
41 pin
42 first end of inner elongated body
44 second end of inner elongated body
46 side wall
48 side wall
50 second inner cavity
52 pallet
54 pallet
56 center cam follower
58 latch assembly
60 lost motion torsional spring
62 lost motion torsional spring
64 short leg
66 short leg
68 long leg
70 long leg
72 contact surface of leg
74 contact surface of leg
76 contact surface of pallet
78 contact surface of pallet
80 recess
82 recess

The invention claimed is:

1. A switchable roller finger follower comprising:

an outer elongated body having a valve stem end, a lash adjuster end and two outer elongated body side walls;

a first inner cavity in said outer elongated body;

two lost motion spring pins attached to said lash adjuster end of said outer elongated body;

two lost motion spring stops, one of each of said stops on one of each of said outer elongated body side walls adjacent said lash adjuster end;

an inner elongated body positioned in said first inner cavity and having a first end pivotally attached to said outer elongated body at said valve stem end a second end adjacent said lash adjuster end of said outer elongated body and two inner elongated body sidewalls;

a second inner cavity in said inner elongated body;

two lost motion spring pallets, one of each of said pallets fixed on one of each of said inner elongated body side walls and adjacent said second end of said inner elongated body;

a center cam follower in said second inner cavity a latch assembly for preventing pivoting of the inner elongated body; and two lost motion torsional springs, one of each of said springs on one of each on said lost motion pins, each of said springs having a short leg and a long leg, the short leg of each of said springs abutting one of said stops and the long leg of each of said springs abutting one of said pallets.

2. The follower of claim 1 wherein said long leg of each of said springs has a contact surface and each of said pallets has a contact surface and said contact surface of said long leg contacts said contact surface of said pallets.

3. The follower of claim 2 wherein said contact surface of each of said pallets is convex.

4. The follower of claim 2 wherein said contact surface of said long leg of each of said springs is convex.

5. The follower of claim 2 wherein said contact surface of each of said pallets is convex and said contact surface of said long leg of each of said spring is convex.

6. The follower of claim 2 wherein said contact surface of each of said pallets and said contact surface of said long leg of each of said spring is involute.

7. The follower of claim 2 wherein said contact surface of said pallet is involute and said contact surface of said long leg of each of said springs is convex.

8. The follower of claim 1 wherein each of said pallets is mounted on an outside surface of said inner elongated body side wall.

9. The follower of claim 1 further comprising a recess in an inside surface of each of said outer elongated body sidewalls for accommodating movement of said pallets.

* * * * *